US007631694B2

(12) United States Patent
Struyk et al.

(10) Patent No.: US 7,631,694 B2
(45) Date of Patent: Dec. 15, 2009

(54) DOWNHOLE STEAM INJECTION SPLITTER

(76) Inventors: Arnoud Struyk, 221 Woodbriar Circle. S.W., Calgary, AB (CA) T2W 6B3; Denis Gilbert, 167 Woodside Rd., Airdrie, AB (CA) T4B 2E2

( * ) Notice: Subject to any disclaimer, the term of this patent is extended or adjusted under 35 U.S.C. 154(b) by 5 days.

(21) Appl. No.: 12/015,398

(22) Filed: Jan. 16, 2008

(65) Prior Publication Data

US 2008/0169095 A1 Jul. 17, 2008

Related U.S. Application Data

(60) Provisional application No. 60/885,194, filed on Jan. 16, 2007.

(51) Int. Cl.
*E21B 43/24* (2006.01)

(52) U.S. Cl. ..... 166/272.3; 166/303; 166/57

(58) Field of Classification Search ..... 166/250.06, 166/303, 57, 272.3
See application file for complete search history.

(56) References Cited

U.S. PATENT DOCUMENTS 2,161,557 A * 6/1939 Clark ..... 166/64
4,366,860 A * 1/1983 Donaldson et al. ..... 166/303
4,640,355 A 2/1987 Hong et al.
5,141,054 A 8/1992 Alameddine et al.
5,289,881 A 3/1994 Schuh
5,626,193 A 5/1997 Nzekwu et al.
5,826,655 A 10/1998 Snow et al.
5,931,230 A 8/1999 Lesage et al.
6,158,510 A * 12/2000 Bacon et al. ..... 166/272.7
6,708,763 B2 * 3/2004 Howard et al. ..... 166/303
7,150,315 B2 * 12/2006 Michael et al. ..... 166/68.5
2008/0302522 A1 * 12/2008 Ascanio Milano et al. .... 166/57

* cited by examiner

*Primary Examiner*—David J Bagnell
*Assistant Examiner*—Elizabeth C Gottlieb
(74) *Attorney, Agent, or Firm*—Sean W. Goodwin; Linda M. Thompson

(57) ABSTRACT

A modular steam injection line, for use in steam assisted gravity drainage (SAGD) operations for delivery of an equal steam mass flow along a length of the apparatus, incorporates steam splitter modules fluidly connected for forming the steam injection line. Each of the modular steam splitters is fit with interchangeable nozzles for delivering steam to the formation. The interchangeable nozzles have orifices of different sizes and the nozzle orifice size required for each individual module to deliver an equal mass flow of steam from each module, at sub-sonic rates, along the entire length of the steam injection line.

21 Claims, 9 Drawing Sheets

DOWNHOLE STEAM INJECTION SPLITTER

CROSS REFERENCE TO RELATED APPLICATION

This application is a regular application claiming priority of U.S. Provisional Patent application Ser. No. 60/885,194, filed on Jan. 16, 2007, the entirety of which is incorporated herein by reference.

FIELD OF THE INVENTION

The invention relates to steam injection devices used in particular for steam injection into downhole reservoirs in a Steam Assisted Gravity Drainage (SAGD) operation for increasing the reservoir temperature so as to cause bitumen in situ to change from a solid to a liquid state and flow freely to be produced to surface and more particularly to apparatus for injecting an equal mass of steam therealong and a method for providing said apparatus.

BACKGROUND OF THE INVENTION

Conventional methods of injecting steam into reservoir formations are restricted to single and, in some cases, multiple steam injection apparatus deployed along the length of a downhole steam injection line. The conventional steam injection apparatus, as deployed, releases steam mass flows at a rate causing steam to be injected at random along the length of the reservoir steam injection line. The random injection flows result in different steam mass flow injection rates at each point of injection long the injection line and therefore creates an uneven steam distribution in the reservoir. Uneven distribution of steam in the reservoir reduces the efficiency of bitumen extraction.

Further, conventional steam injection apparatus are typically large in design, and require drilled completions to be large in diameter to permit installation of the apparatus. Conventional steam injection apparatus typically suffer, over time and use, from ingress of sand and debris causing clogging and diminishing the operation of the conventional apparatus.

U.S. Pat. No. 5,141,054 to Almeddine et al. teaches supplying steam to a reservoir using a closed-end tubing or liner in a wellbore, the liner having a plurality of spaced apart perforations bored therealong. Almeddine et al. use a number of perforations of controlled size which act as chokes operating under critical or sonic flow conditions which is dependent upon injection pressure only. Almeddine et al. avoid the use of subsonic flow so as to avoid introducing discharge pressure as a variable in the design of the issuing steam rate. A uniform distribution of steam is purported to be achieved throughout the length of the wellbore by controlled steam distribution through ascertained numbers of perforations in the tubing which are sized and spaced specific to the wellbore so as to achieve said critical flow conditions.

U.S. Pat. No. 6,158,510 to Bacon et al. teaches a relatively large diameter, single tubing string used for both steam injection and production. Spaced apart orifices, all of the same size, bored in a base pipe, are used to purportedly deliver steam uniformly to the reservoir at sonic flows. A wire-wrap screen is formed circumferentially about the base pipe to act as a filter for produced fluids flowing back to the perforated base pipe. The pressure drop across the orifices which governs the maximum steam injection rate achievable through an orifice is affected by the number and size of orifices available as well as the diameter of the base pipe. In a SAGD operation, a separate production well is utilized and the number of orifices in the steam injection liner are constrained such that the pressure drop through the orifices is larger than the pressure drop through either the wire-wrap sections or along the liner itself.

Apparatus such as that taught by Almeddine et al. and Bacon et al. are configured to provide critical or sonic flows. Typically, very large quantities or high pressures of steam or alternatively very small steam injection openings are required to maintain such critical flows of steam from all of the openings along the apparatus. Applicant believes that it is difficult to provide sufficient steam from surface to meet critical flow demands at each opening along the steam injection apparatus. Further, Applicant believes that if openings are made sufficiently small to ensure said critical flow at each of the openings, the amount of heat transfer to the formation may be less than effective for a SAGD operation.

Further, in conventional apparatus, the openings or orifices are typically bored through the tubing or liner. Should changes to the size of the openings be required, the apparatus, specifically configured for a particular situation, cannot readily be reused in other formations, particularly in those which may require smaller openings for lesser steam injection rates.

There is interest in the industry in steam injection apparatus which permits smaller diameter tubing for use in conventional wellbores while using relatively low steam pressures, which reliably results in an equal mass distribution of steam at all points of injection along the injection apparatus which resists plugging as a result of sand ingress from the formation and which has means for delivery of steam which can be re-sized for reuse from formation to formation.

SUMMARY OF THE INVENTION

Steam injection apparatus, such as used in a SAGD operation, incorporates a plurality of steam splitter modules, each module being fit with specifically sized orifices so as to deliver substantially equal mass flows of steam to the formation despite changing steam conditions along the length of the steam injection line. In embodiments of the invention, the flow of steam from most of the orifices along the length of the steam injection line is sub-sonic.

In embodiments of the invention, interchangeable nozzles at each module permit selecting orifice sizes specific to the steam conditions at each module. Further, the specifically sized orifices enable delivery of an effective amount of steam at each orifice using a relatively small diameter apparatus at relatively lower supply steam pressures.

Advantageously, the interchangeable nozzles permit reuse of the steam splitter modules in other formations or applications wherein the nozzles are selected and changed accordingly to suit the formation and steam conditions at each module.

Therefore, in one broad aspect, a steam injection apparatus for injection of steam to a subterranean formation comprises: a plurality of steam splitter modules fluidly connected therebetween, adapted for connection to a tubing string, for delivery of steam from surface to the subterranean formation, each of the plurality of steam splitter modules comprising: an inner tube having an axis, an uphole coupling and a downhole coupling and a bore extending therethrough; an outer tube positioned concentrically about at least a portion of the inner tube and forming an annular space therebetween; and one or more ports formed in the inner tube for fluidly connecting the bore to the annular space; and sized orifices in the one or more ports for discharging steam to the annular space, wherein the orifices are sized specific for changing steam conditions at each of the plurality of steam splitter modules so as to deliver a substantially equal mass flow of steam from each of the plurality of steam splitter modules.

In an embodiment of the invention, the ports are angled from perpendicular so as to angularly discharge steam to the annular space between the inner tube and the outer tube. Further, anti-wear means such as wear rings are supported to line an inner wall of the outer tube so as to prevent damage to the outer tube as a result of impact by the steam.

In an embodiment of the invention, filter screens are supported across the annular space to prevent the ingress of sand into the orifices of the nozzles when the apparatus is not being used. In one embodiment, two or more filter screens, such as sintered metal screens are positioned, at least one uphole and at least one downhole from the ports, sandwiching the ports therebetween.

In another broad aspect, a method for assembling a steam injection line for delivery of steam to a subterranean formation comprises: providing a plurality of steam splitter modules, each of the plurality of steam splitter modules comprising: an inner tube having an upper coupling and a lower coupling and a bore extending therethrough; an outer tube positioned concentrically about at least a portion of the inner tube and forming an annular space therebetween; and one or more ports formed in the inner tube for fluidly connecting the bore to the annular space; calculating a specific orifice size for the one or more ports according to steam conditions at each of the plurality of steam splitter modules so as to deliver a mass flow of steam from first sized orifices of a first steam splitter module of the plurality of steam splitter modules that is substantially the same as a mass flow of steam delivered from subsequent sized orifices in each subsequent steam splitter module of the plurality steam splitter modules; and fitting the specifically sized orifices in the one or more ports of each of the plurality of steam splitter modules.

In embodiments of the invention, the specifically sized orifices are in interchangeable nozzles fit to the one or more ports in each steam splitter module.

DESCRIPTION OF THE INVENTION

Apparatus for the injection of steam to a formation, typically referred to as a steam injection splitter for use in a steam injection line, according to embodiments of the present invention, are based on the following operating principles. Steam is produced at surface and is injected into the steam injection line which runs from surface to downhole in a wellbore drilled into the formation. Persons of skill in the art are familiar with the methods and apparatus used for injecting steam into subterranean reservoir formations through said downhole steam injection lines. The steam is contained inside the steam injection line and enters a plurality of steam injection splitters for delivery to the formation. Such apparatus can be implemented to assist in the recovery of hydrocarbons from bitumen based reservoir formations, also known as SAGD (Steam Assisted Gravity Drainage) completions, but is not limited to this implementation. The apparatus according to embodiments of the invention can be used in any implementation where control of steam mass flow along a long steam injection line is desired.

Figure 5A:
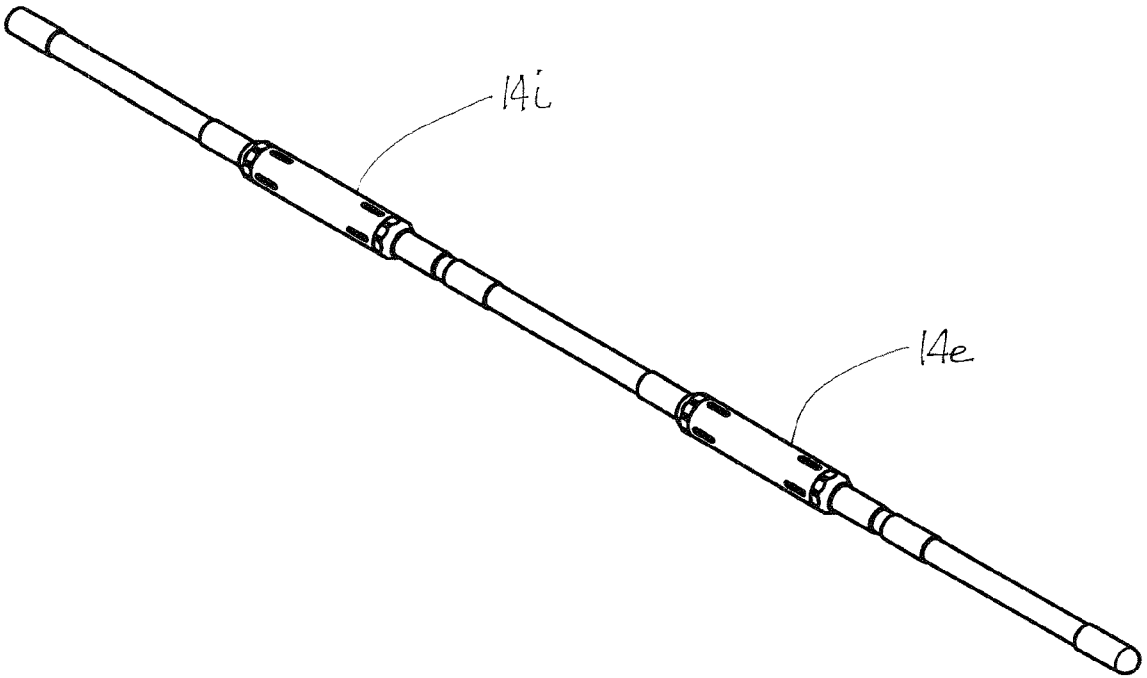
FIG. 5A is a partial perspective view of a steam injection line comprising at least a steam splitter according to FIG. 1 and a steam splitter according to FIG. 4A.
Figure 5B:
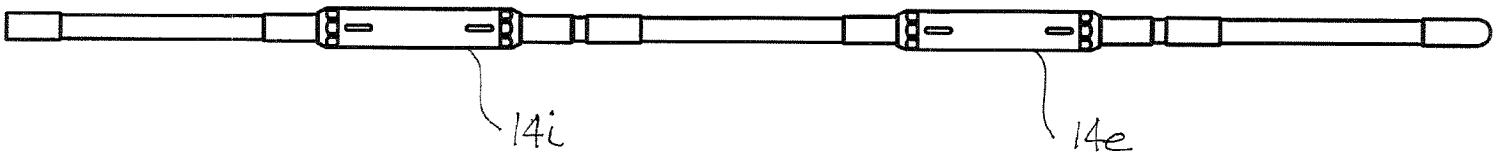
FIG. 5B is a side view according to FIG. 5A.
Figure 6:
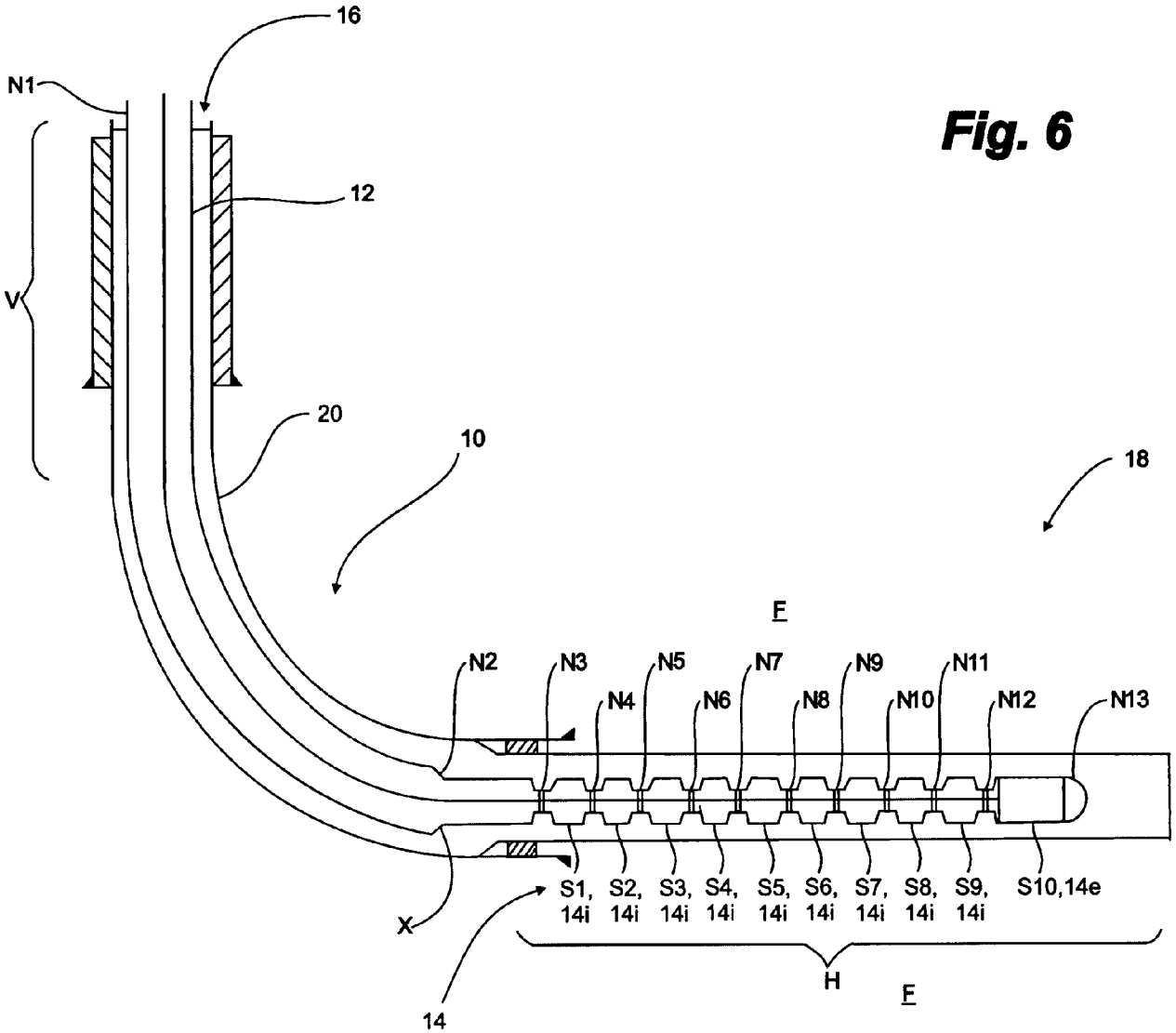
FIG. 6 is a fanciful perspective view of a steam injection line, comprising a plurality of steam injection splitters according to FIG. 1 and an end steam injection splitter according to FIG. 4A, installed in a horizontal wellbore for injection of steam therein.

According to embodiments of the invention and having reference to FIGS. 1A-6, a steam injection line 10 comprises a tubing string 12 having a plurality of steam splitter modules 14 fluidly connected therein, in contiguous fluid communication, for forming the steam injection line 10. The steam splitter modules 14 typically comprise steam splitter modules 14*i* (FIG. 6), designed for use intermediate a surface end 16 and a downhole end 18 of the steam injection line 10, and an end splitter module 14*e* (FIGS. 4A and 4B) designed for use at the downhole end 18 of the steam line injection line 10 (FIGS. 5A-6).

As shown in FIG. 6, the plurality of steam splitter modules 14 are fluidly connected in the steam injection line 10 so as to be positioned to correspond to a portion of a formation F to be stimulated using steam when the steam injection line 10 is inserted into a wellbore 20 therein. For example, a typical steam injection installation may be 700 m (2296 ft) in length, with 5 to 20 injection steam splitters 14 along the prescribed length of the steam injection line 10.

Figure 1A:
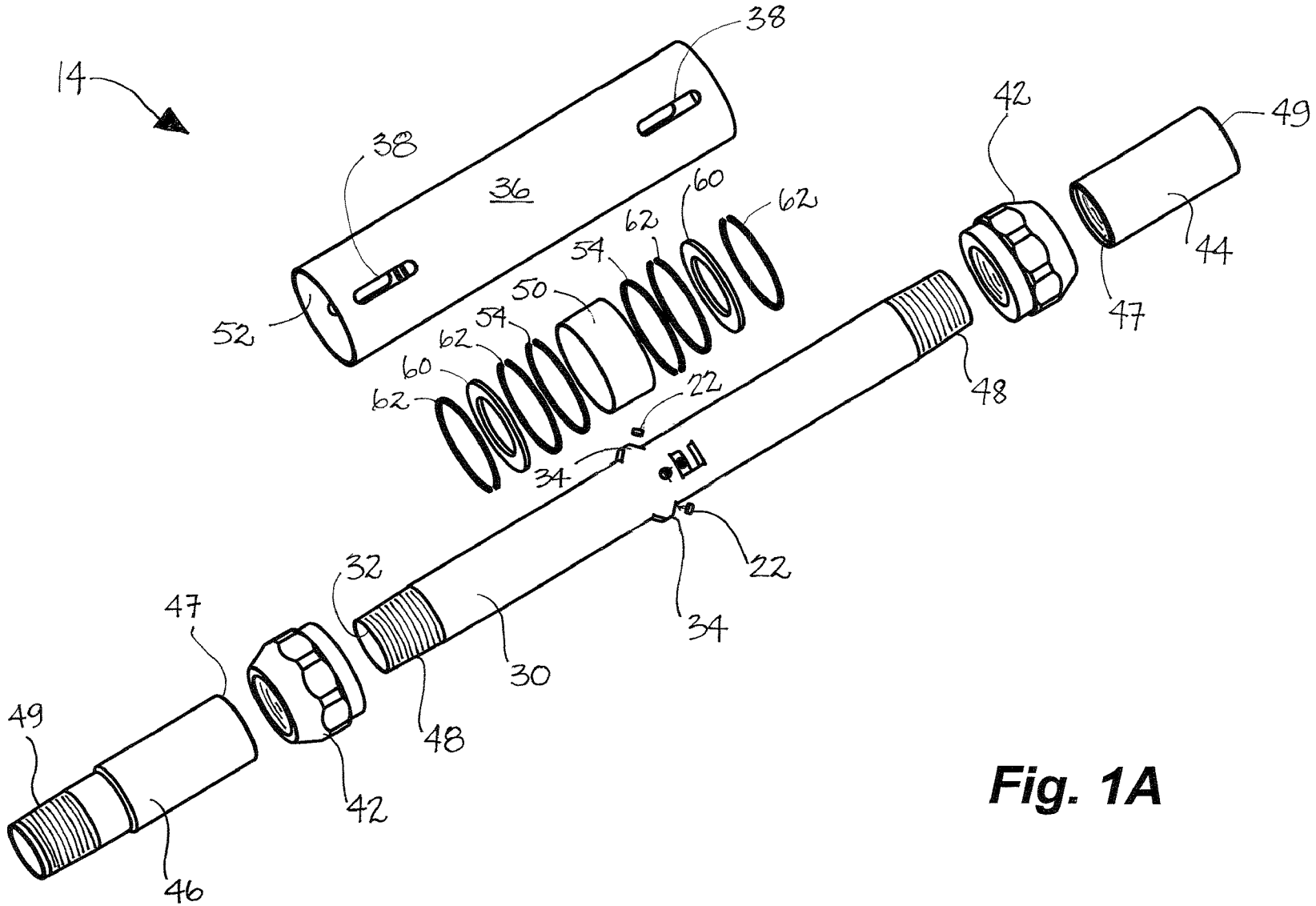
FIG. 1A is an exploded perspective view of a steam injection splitter apparatus according to an embodiment of the invention.
Figure 3A:
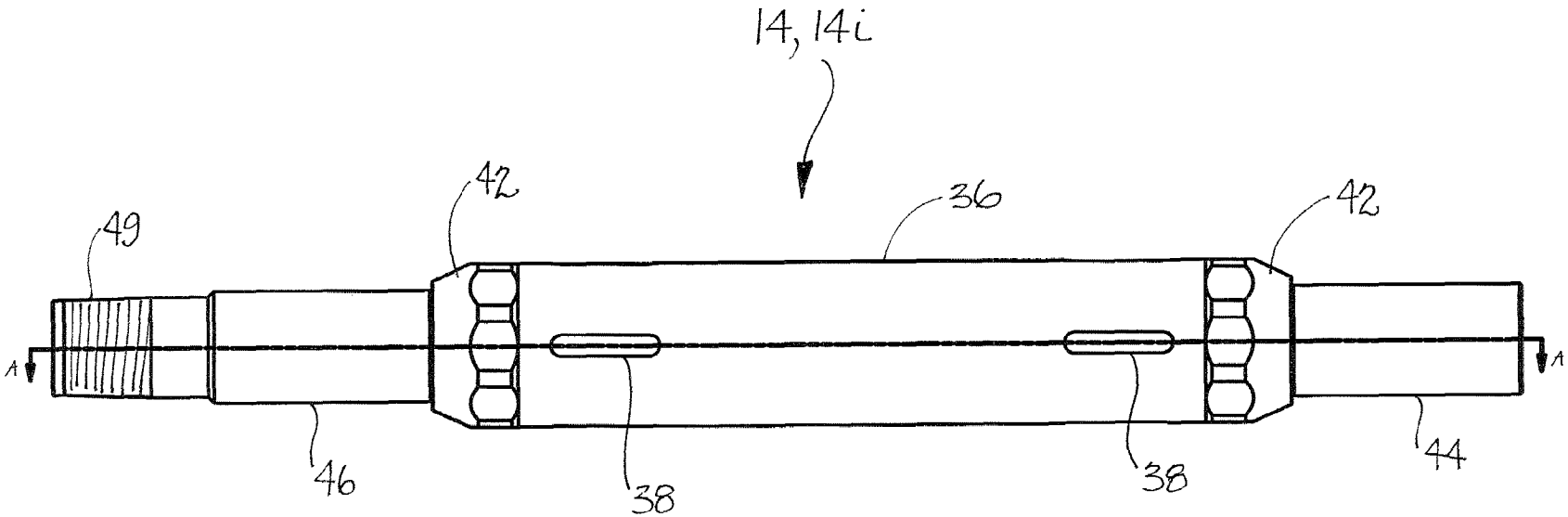
FIG. 3A is a side view of the apparatus according to FIG. 1A.
Figure 3B:
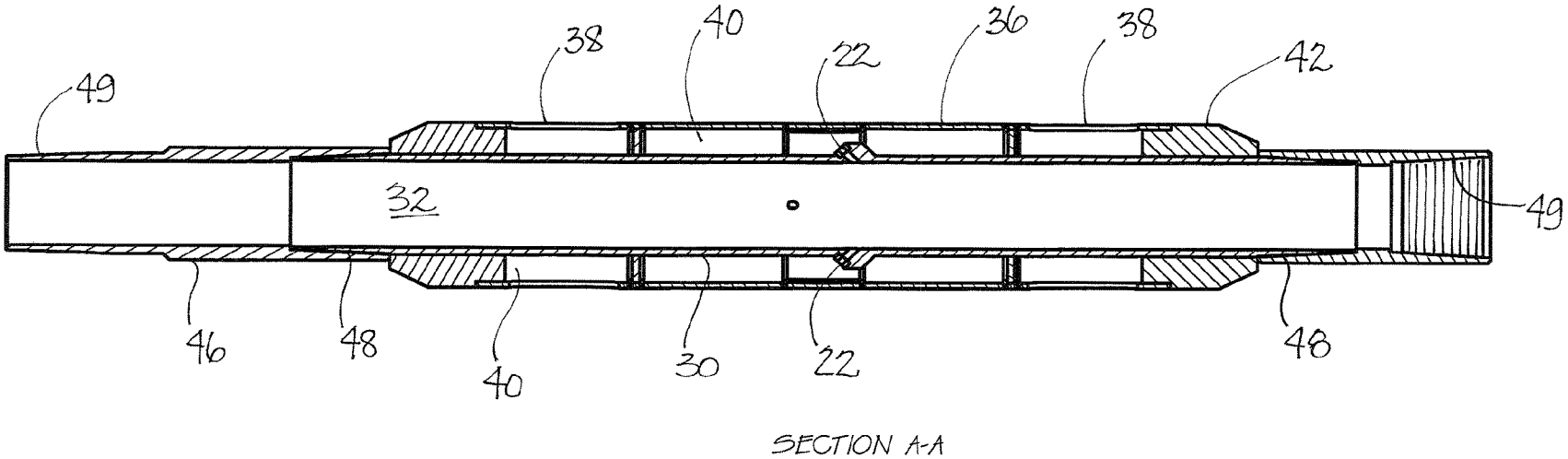
FIG. 3B is a longitudinal sectional view according to FIG. 1A.
Figure 3C:
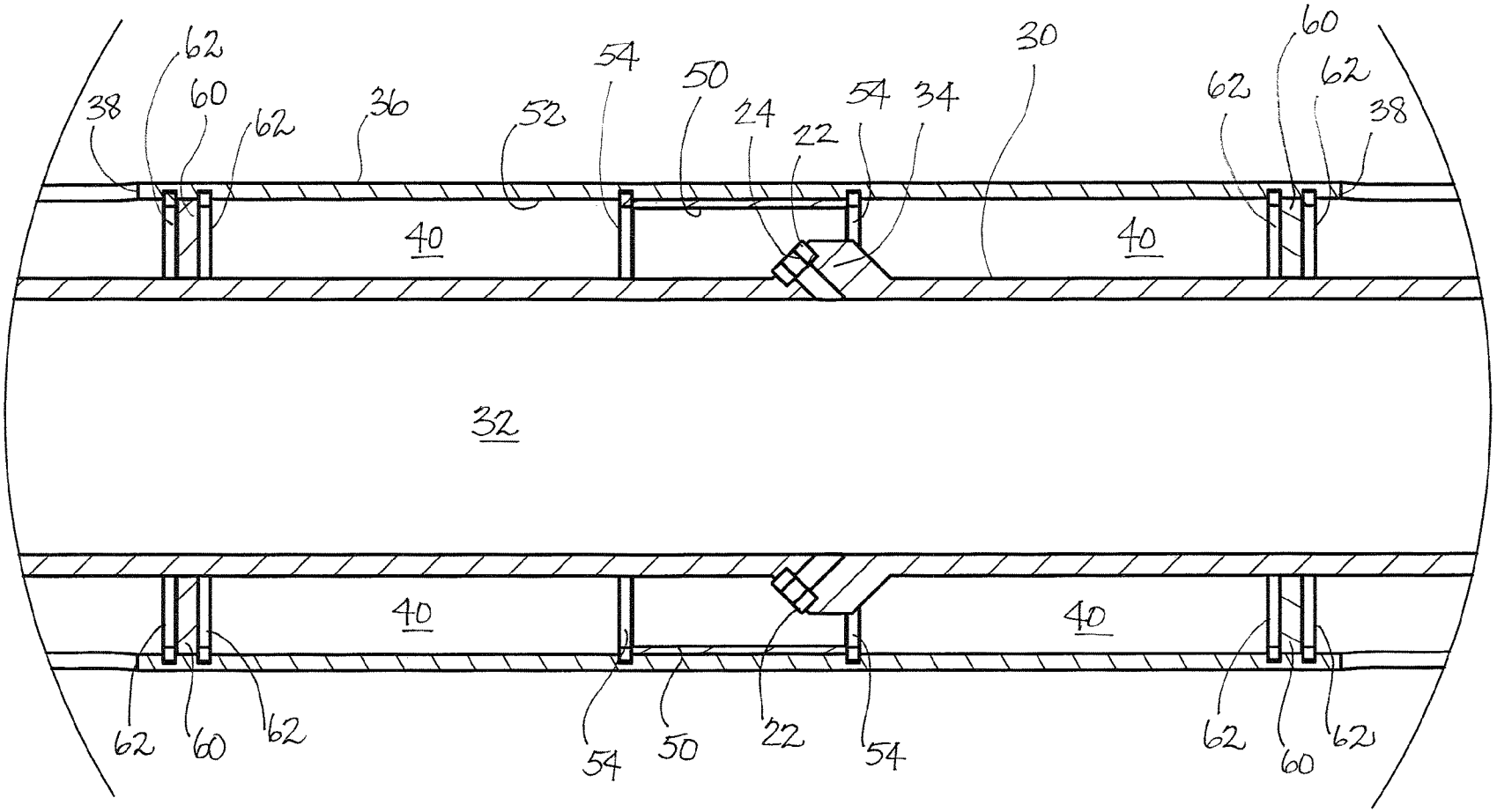
FIG. 3C is a partial longitudinal sectional view according to FIG. 3B illustrating angled ports formed therein.
Figure 4B:
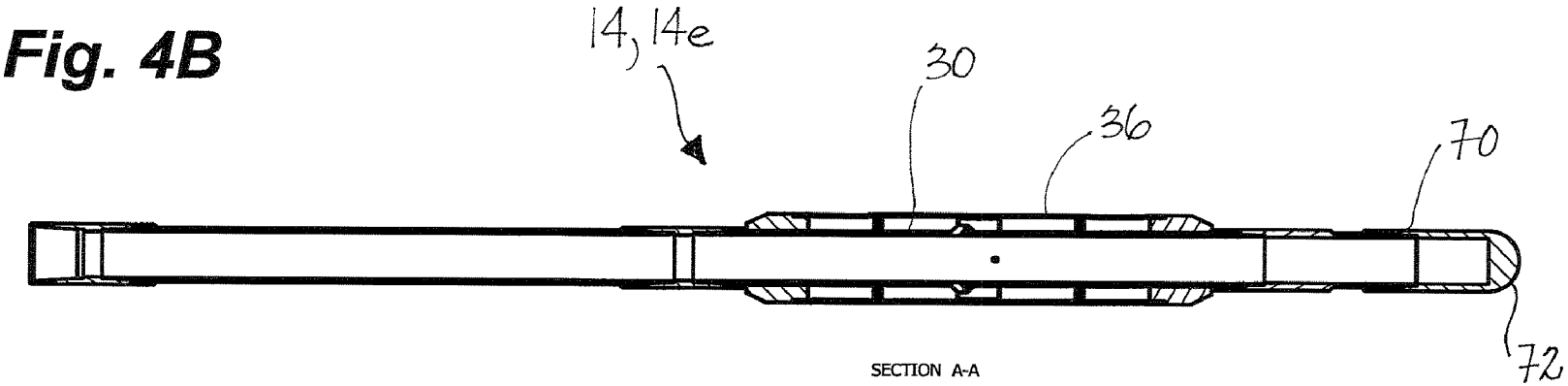
FIG. 4B is a longitudinal sectional view according to FIG. 4A.
Figure 4A:
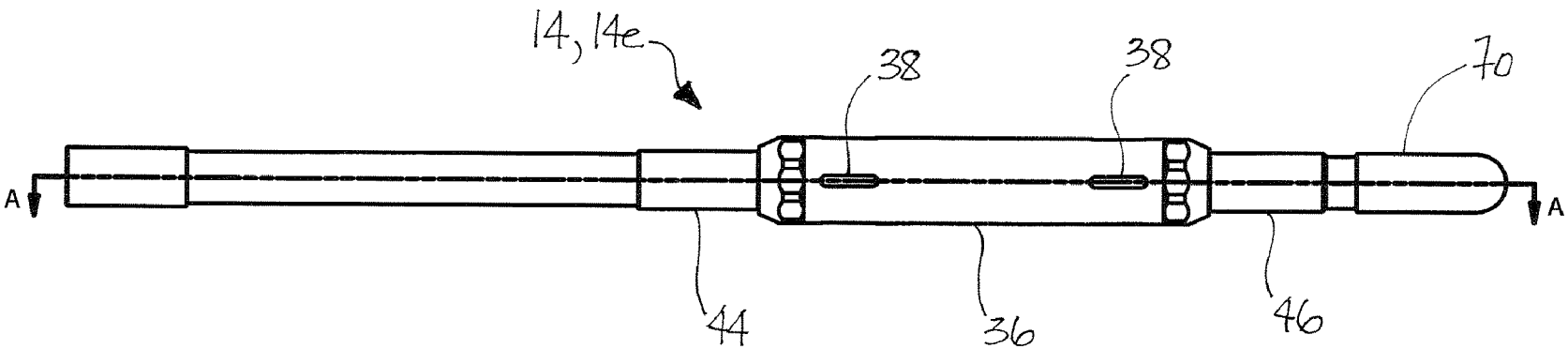
FIG. 4A is a side view of a steam injection splitter end module suitable for use at an end of a steam injection line according to an embodiment of the invention.

As shown in FIGS. 1A, 3B and 3C and in an embodiment of the invention, each of the plurality of steam splitter modules 14 generally comprise interchangeable nozzles 22 for permitting sizing of orifices 24 in the nozzles 22 unique to each of the steam splitter modules 14 for discharging an equal mass of steam to the formation F from each of the steam splitter modules 14.

In an embodiment of the invention, each module 14 comprises an inner tube 30 having a bore 32 and one or more ports 34 formed therethrough for transporting steam flowing through the bore 32 outwardly from the bore 32. The interchangeable nozzles 22, having sized orifices 24 specific for each of the steam splitter modules 14, are fit within the ports 34. An outer sleeve or tube 36 having slots or perforations 38 formed therethrough is positioned concentrically about the inner tube 30 creating an annular space 40 therebetween.

Figure 1B:
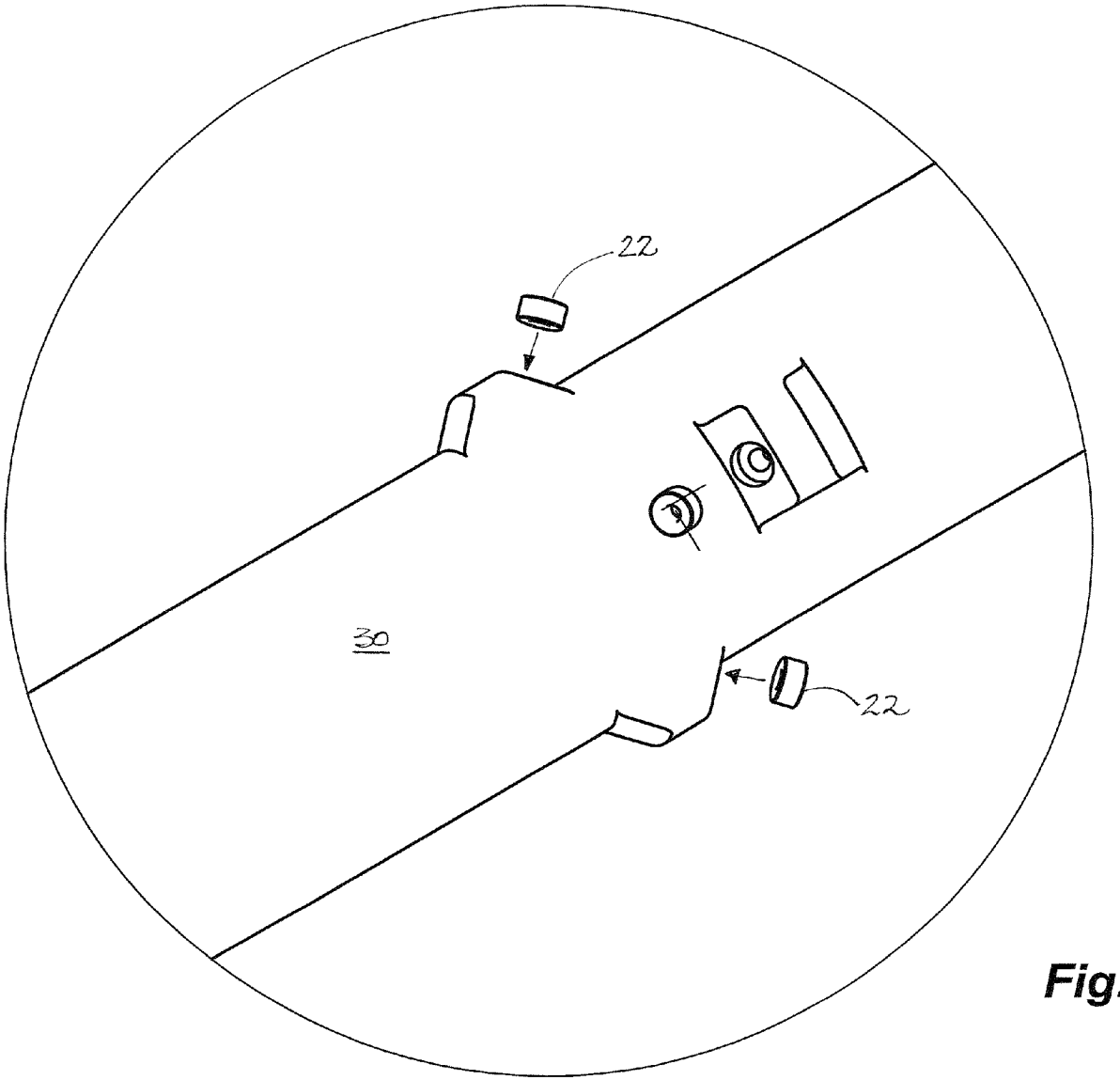
FIG. 1B is a partial perspective view of an inner tube according to FIG. 1A illustrating angled ports formed therein and fit with replaceable nozzles for delivering steam therefrom.
Figure 2:
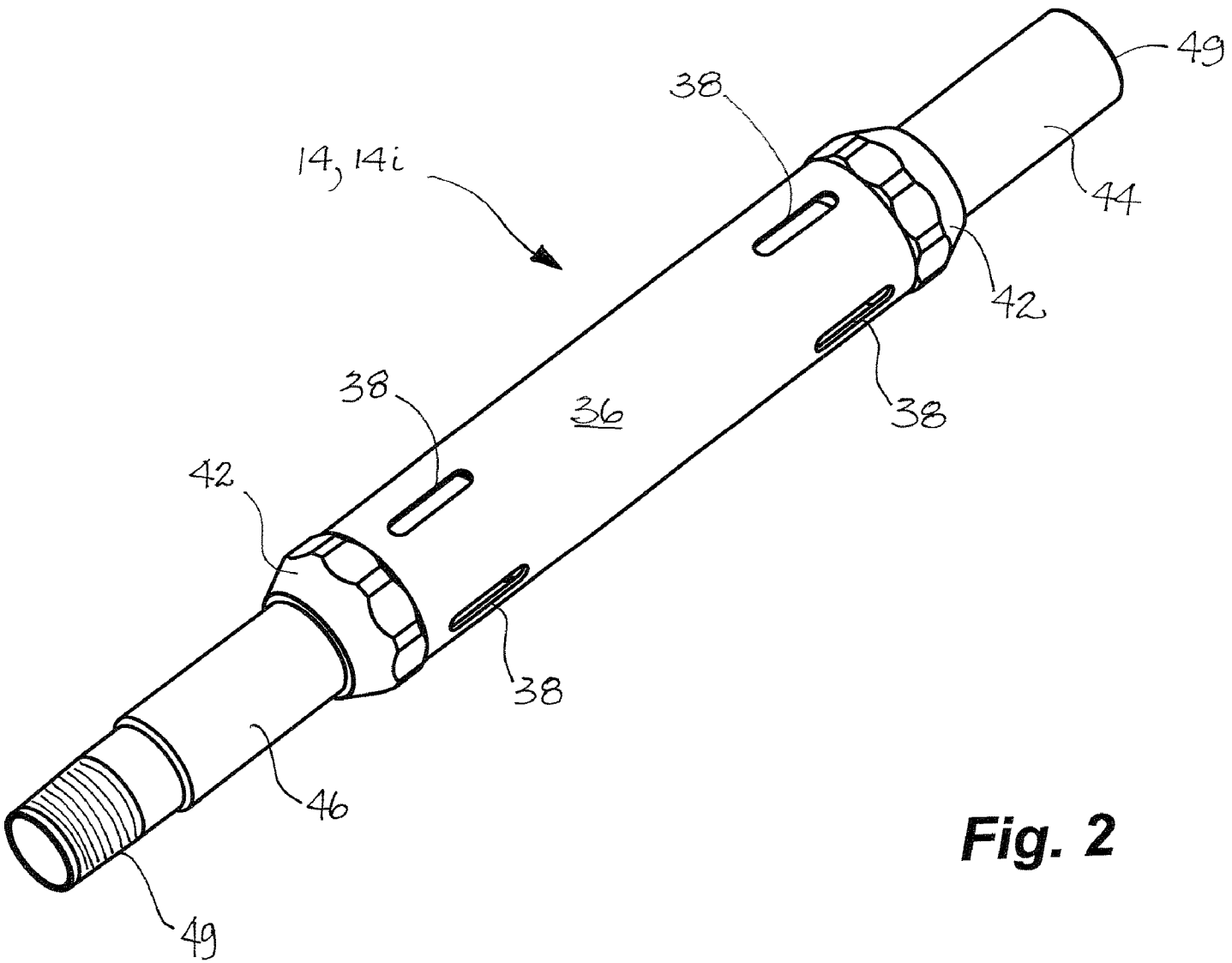
FIG. 2 is an assembled perspective view according to FIG. 1A.

Having reference to FIGS. 1B, 3B and 3C and in an embodiment of the invention, the ports 34 are angled from perpendicular for angularly discharging steam from the nozzles 22 installed therein to the annular space 40. Steam is discharged from the bore 32 through the angled ports 34 and nozzle orifices 24 into the annular space 40 and from the annular space 40 through the outer tube perforations 38 for release to the formation F, such as through perforations in a casing, also known as a slotted liner, or directly to the formation in an uncased wellbore.

Each steam splitter module 14 is fit with the one or more interchangeable nozzles 22 having the sized orifices 24 so as to provide a substantially consistent or equal mass of steam to the formation F at each of the steam splitter modules 14. Nozzle orifice size is typically calculated based upon changing steam conditions at each of the plurality of modules which is determined by a number of parameters, including but not limited to, steam mass flow available at surface in tonnes/day or steam mass flow in kg/hr, formation pressure (kPa), the number of steam splitter modules 14 to be incorporated in the injection line, whether one or more nozzles 22 are to be incorporated in the end steam splitter 14*e*, tubing dimensions including an inner diameter ID and an outer diameter OD at the steam splitter modules 14 and between the steam splitter modules 14, any restrictions in the diameter of the steam injection line 10, the overall length of the steam injection line 10, the distance between steam splitter modules 14 and the number of nozzles 22 in each of the steam splitter modules 14.

In embodiments of the invention, the nozzles 22 on each steam splitter module 14 can be specified to regulate operator-defined steam mass flow injection requirements at each steam splitter module 14. As will be appreciated by one of skill in the art, the one or more interchangeably secured nozzles 22 in each steam splitter module 14 can be removed and replaced with nozzles 22 calculated to have the required orifice size so as to readily permit reuse of the steam splitter modules 14 regardless the formation parameters or intended use. Typically, nozzles 22 are secured to the ports 34 by silver soldering.

Use of the interchangeable, specifically sized nozzle orifices 24 permits a relatively small diameter apparatus which is capable of use at relatively lower steam pressures. In embodiments of the invention, the steam injection line 10 has a diameter of about 2-⅞ inches compared to conventional apparatus having a diameter of about 5-½ inches. The steam injection line 10 according to this embodiment is capable of subsonic delivery of substantially equal mass flows of steam using a steam pressure of about 5 MPa which is significantly lower than the about 11 MPa which apparatus such as taught in U.S. Pat. No. 6,158,510 to Bacon et al. would require to achieve critical or sonic flow.

As shown in FIG. 1A, the outer tube 36 is held in position concentrically about the inner tube 30 by end caps 42. The end caps 42 are secured into position on the inner tube 30 by an uphole coupling 44 and a downhole coupling 46. In one embodiment, the uphole and downhole couplings 44,46 are threaded 47 for connection to threaded ends 48 of the inner tube 30, sandwiching the outer tube 36 into position between the end caps 42. Threaded ends 49 of the uphole and downhole couplings 44,46 are utilized for securing the one or more steam splitter modules 14 together for forming at least a portion of the steam injection line 10. Typically, the threaded end 49 of at least the uphole coupling 44 is used for connecting the steam splitter modules 14 to the tubing string 12 from surface for forming a contiguous bore 32 therethrough to permit delivery of steam from surface to the fluidly connected steam splitter modules 14.

Steam flowing through the nozzle orifices 24 at high velocity into the annular space 40 has a highly erosive effect and therefore, in embodiments of the invention, as shown in FIGS. 1A and 3C, anti-wear means 50 are utilized to avoid damage to an inner wall 52 of the outer tube 36. The nozzles 22 and anti-wear means 50 are typically manufactured of wear resistant materials, such as tungsten, tungsten carbide or other such hard material highly resistant to erosion.

In embodiments of the invention, as shown in FIG. 3C, the anti-wear means are wear rings 50 which are retained in concentric position within the outer tube 36 by inner retaining rings 54 so as to line the inner wall 52 of the outer tube 36 about an area of impact of the steam.

Steam splitter end modules 14*e* can have one or more nozzles 22 directed along an axis of the wellbore which avoids erosive effects. An end steam splitter module 14*e* can be closed having no ports 34 or interchangeable nozzles 22 therein or can have a port 34 formed in an end 70 at the downhole end 18 of the steam injection line 10.

Having reference again to FIGS. 1A and 3C, ingress of sand into the steam splitter modules 14 is prevented by positioning at least two filter screens 60 across the annular space 40 between the inner and outer tubes 30,36. In one embodiment, sintered metal filter screens 60 are used. The filter screens 60 are retained in position across the annular space 40 by inner screen-retaining rings 62. The filter screens 60 substantially eliminate sand ingress from the reservoir or formation F preventing clogging of the nozzle orifices 24. In embodiments of the invention, the at least two filter screens 60 are positioned uphole and downhole from the one or more ports 34 so as to sandwich the one or more ports 34 therebetween.

In order to properly calculate the orifice size of the interchangeable nozzles 22 to suit the intended use, steam injection calculations are made by first defining the following parameters:

- Steam mass flow available at surface in [tonnes/day];
- Steam condition at surface injection line entry point [kPa];
- Down hole Formation/Reservoir Pressure [kPa];
- Length of steam injection line measured line measured from surface to point where first steam injector is projected [m];
- Internal diameter (ID) of steam injection line from surface to point where diameter increases or decreases (cross-over);
- Projected number of steam injectors along the horizontal section of the steam injection line and is there a projected single nozzle opening at the very end of the line;
- Diameter of steam injection line sections between steam injectors; and
- Any change in pipe diameter in the horizontal section i.e. restrictions in ID of the steam splitters.

In one embodiment, a pipe isometric file is created using conventional incompressible fluid pressure drop calculation software, such as ES_dPCalc® available from ENGsoft Inc., Seoul, Korea, and the above-defined parameters, for modeling vertical V and horizontal H sections of a steam injection line 10. Calculations are made to reflect whether the end splitter module 14*e* is closed or has one or more open nozzles 22 incorporated therein.

The following data are entered to calculate the pressure drop in the steam injection line:

- pipe data for the vertical section including nominal diameter (ND), inner diameter (ID), outer diameter (OD) and orientation i.e. vertical offset (depth);
- pipe data for the horizontal pipe sections between steam injectors based on desired number of steam injectors, including nominal diameter (ND), inner diameter (ID), outer diameter (OD).
- Data regarding restrictions in the steam injector line, each section having a restriction being modeled as a separate pipe section.

After creation of the model, surface steam pressure [kPa] is entered into ES_dPCalc® to create a steam table comprised of relevant data such as steam temperature, specific volume, enthalpy and absolute viscosity. Using the data from the steam table, the steam mass flow available at surface in [kg/hr] is entered into ES_dPCalc®.

Based on the number of projected steam splitter modules 14 to be installed in the steam injection line 10, node flows are defined. The mass flow of steam to be injected into the formation at each steam splitter module 14 is defined. For example, starting at surface and having 20000 kg/hr mass flow with 10 steam splitter modules and a node flow at a first steam splitter module of 2000 kg/hr, the mass flow remaining to flow to the next node at a subsequent or second steam splitter module would be 20000 kg/hr minus 2000 kg/hr to equal 18000 kg/hr. Assuming a node flow of 2000 kg/hr at the second steam splitter module, the remaining amount of steam after the second steam splitter module would be 18000 kg/hr minus 2000 kg/hr or 16000 kg/hr. Similarly, the remaining subsequent steam splitter modules each have a node flow of 2000 kg/hr leaving a remaining mass flow of 2000 kg/hr at the tenth and final steam splitter module.

Based on the node flows entered, ES_dPCalc® calculates the pressure drop in the steam injection line 10 and the change in steam conditions between each of the steam splitter modules 14. The calculated results are printed and used subsequently to calculate the nozzle orifice sizes for each projected steam splitter module 14 along the steam injection line 10. The resulting calculation gives the steam pressure [kPa] at each steam splitter module 14.

To calculate the steam conditions at each steam splitter nozzle 22, a compressible flow analysis software program, such as ES_StmNzl® available from ENGsoft Inc., Seoul, Korea, is used. The steam pressure data calculated using the ES_dPCalc® program is entered as input data to calculate the inlet stagnated steam condition for each steam splitter module 14 location along the steam injection line 10. Additional necessary data is entered using a built-in steam table. The program calculates the nozzle throat steam condition based on entered data and discharge pressure which in this case is the formation/reservoir pressure. The calculated data, as defined below, is then used to calculate the nozzle orifices 24 for the steam splitter module 14 design:

Conditions at Inlet:

- Steam Pressure at Inlet [kPa]
- Steam Temperature [°C.]
- Specific Volume [$m^3$/kg]
- Enthalpy [kJ/kg]

Calculated Condition Nozzle Throat Steam:

- Steam Pressure at Inlet [kPa]
- Steam Temperature [°C.]
- Specific Volume [$m^3$/kg]
- Enthalpy [kJ/kg]
- Steam Velocity [m/s]
- Mass Flow per the Unit Area of Nozzle Throat [kg/hr/$m^2$]

Nozzle orifice size calculations are done using Applicant's in-house developed spreadsheet, using Microsoft EXCEL. The spreadsheet utilizes the data calculated from the ES_StmNzl®, and the following data which is entered into the spreadsheet:

- steam mass flow available at surface [tonnes/day];
- number of projected steam splitters;
- the percentage of steam mass flow to be available for end nozzle [%] if a single nozzle opening is required at the end of the injection line;
- pipe dimensions, OD and ID [mm];
- OD of tubing inserted into the steam injection line [mm], if there is an instrumentation line inserted into the steam injection line;
- overall length of steam injection line [m];
- distance between equally spaced injector subs [m];
- steam mass flow rate in [kg/hr]; and
- number of openings in each steam splitter.

The steam mass flow [tonnes/day] is converted to mass flow in [kg/hr]. Using the desired percentage of steam mass flow to exit from the end nozzle 22, the average steam mass flow to be discharged from each steam splitter module node is calculated as is the size of the nozzle orifice 24. The nozzle orifices 24 allow a consistent steam mass flow to be injected into the formation based on the steam conditions that exist at the steam splitter module 14. If multiple nozzles 22 are to be fitted to a single steam splitter module 14, the spreadsheet calculates each nozzle orifice 24.

EXAMPLE 1

Having reference to FIG. 6 and in a horizontal wellbore, such as used for steam injection in a SAGD operation, nozzle orifice sizes were calculated for a steam injection line 10 having ten steam splitter modules S1, S2 . . . S10. This embodiment results in a steam injection line 10 having thirteen nodes N1, N2 . . . N13 at which flows are determined.

In this example, the downhole end 18 of the steam injection line 10 was closed. Each steam splitter module 14 was designed to have four nozzles 22. The wellbore conditions and steam injection line parameters were defined as shown in Table A:

TABLE A

| | | |
|---|---|---|
| Steam Injection Pressure at wellhead | 5500 | kPa |
| Formation pressure | 4000 | kPa |
| Steam Rate | 500 | tonnes/day |
| Distance from Wellhead to crossover | 690 | m |
| Horizontal Distance Heel-Toe | 693 | m |
| ID vertical section 5.5" Tubing | 124.3 | mm |
| OD Coiled Tubing String 1.5" | 31.75 | mm |
| ID of horizontal section 4.5" Tubing | 100.5 | mm |

The location of the steam injection splitter modules 14 was measured from a crossover X from the vertical section V of the tubing string 12 to the horizontal section H of the steam injection line 10, resulting in a reduction in the diameter of the tubing from 5.5" to 4.5", as shown in Table B:

TABLE B

| Splitter # | Distance from crossover (m) |
|---|---|
| 1 | 37 |
| 2 | 84.6 |
| 3 | 129 |
| 4 | 175 |
| 5 | 220 |
| 6 | 266 |
| 7 | 312 |
| 8 | 357 |
| 9 | 403 |
| 10 | 449 |
| End of line | 690 |

The upstream steam conditions were defined as shown in Table C:

TABLE C

| | | |
|---|---|---|
| Pressure | 5500 | kPa a |
| Temperature | 269.9318° | C. |
| Specific Volume | 3.562905E−02 | $m^3$/kg |
| Enthalpy | 2789.923 | kJ/kg |
| Quality | 1 | |
| Mass Flow | 20830 | kg/hr |
| Volume Flow | 742.1531 | $m^3$/hr |
| Absolute Viscosity | 1.828132E−02 | cP |
| Specific Heat Ratio | 1.135 | |

The node flows in kg/hr were defined as shown in Table D:

TABLE D

| Node # | Location | Flow kg/hr |
|---|---|---|
| 1 | Surface | 20830 |
| 2 | Crossover (5.5-4.5) | 0 |
| 3 | Splitter 1 | −2083 |

TABLE D-continued

| Node # | Location | Flow kg/hr |
|---|---|---|
| 4 | Splitter 2 | −2083 |
| 5 | Splitter 3 | −2083 |
| 6 | Splitter 4 | −2083 |
| 7 | Splitter 5 | −2083 |
| 8 | Splitter 6 | −2083 |
| 9 | Splitter 7 | −2083 |
| 10 | Splitter 8 | −2083 |
| 11 | Splitter 9 | −2083 |

TABLE D-continued

| Node # | Location | Flow kg/hr |
|---|---|---|
| 12 | Splitter 10 | −2083 |
| 13 | End nozzle closed | 0 |

Pressures at each node N1 . . . N13 within the steam injection line 10 were summarized as shown in Table E:

TABLE E

| Node # | Location | North (m) | East (m) | Up (m) | Pressure kPa a |
|---|---|---|---|---|---|
| 1 | Surface | 0 | 0 | 0 | 5500.0 |
| 2 | Crossover (5.5-4.5) | 0 | 0 | −690 | 5263.3 |
| 3 | Splitter 1 | 37 | 0 | −690 | 5184.783 |
| 4 | Splitter 2 | 84.6 | 0 | −690 | 5101.607 |
| 5 | Splitter 3 | 129 | 0 | −690 | 5039.208 |
| 6 | Splitter 4 | 175 | 0 | −690 | 4989.01 |
| 7 | Splitter 5 | 220 | 0 | −690 | 4952.493 |
| 8 | Splitter 6 | 266 | 0 | −690 | 4926.309 |
| 9 | Splitter 7 | 312 | 0 | −690 | 4909.399 |
| 10 | Splitter 8 | 357 | 0 | −690 | 4900.006 |
| 11 | Splitter 9 | 403 | 0 | −690 | 4895.681 |
| 12 | Splitter 10 | 449 | 0 | −690 | 4894.565 |
| 13 | End Nozzle | 690 | 0 | −690 | 4894.565 |

Should the horizontal portion H of the wellbore deviate from horizontal, pressure differentials resulting from the deviation from horizontal at each steam splitter module 14 are calculated for correcting subsequent calculations. In the example shown, the wellbore was determined to be substantially horizontal.

In the example shown in FIG. 6, the nominal diameter of the tubing string 12 at the vertical section V was 5.5 inches with an inner diameter of about 120 mm when compensated for an indwelling instrument string. The friction factor was 0.0159f and the turbulent friction factor was 0.0157 fT.

At the horizontal section H, after the cross-over X, the nominal diameter was 4.5 inches with an internal diameter of about 95.5 mm when compensated for the indwelling instrument string. The friction factor was 0.0167f and the turbulent friction factor was 0.0165 fT. Additional parameters at each node N1 . . . N13 were calculated and the results are shown in Table F for mass flow rates of 1083 kg/hr at each steam splitter module.

TABLE F

| Node | Pipe Flow (kg/hr) | Reynolds # | Total resistance coefficient (K) | Velocity (m/s) | Pipe Length (m) | Pipe elevation difference (m) | Pressure kPa a |
|---|---|---|---|---|---|---|---|
| 1 | 20830 | 3.361E+06 | 91.515 | 18.2 | 690 | −690 | 5500 |
| 2 | 20830 | 4.248E+06 | 6.455 | 30.2 | 37 | 0 | 5263.3 |
| 3 | 18747 | 3.831E+06 | 8.311 | 27.6 | 47.6 | 0 | 5184.783 |
| 4 | 16664 | 3.412E+06 | 7.76 | 24.9 | 44.4 | 0 | 5101.607 |
| 5 | 14581 | 2.99E+06 | 8.05 | 22.1 | 46 | 0 | 5039.208 |
| 6 | 12498 | 2.566E+06 | 7.889 | 19.1 | 45 | 0 | 4989.01 |
| 7 | 10415 | 2.141E+06 | 8.084 | 16.1 | 46 | 0 | 4952.493 |
| 8 | 8332 | 1.714E+06 | 8.113 | 12.9 | 46 | 0 | 4926.309 |
| 9 | 6249 | 1.286E+06 | 7.984 | 9.7 | 45 | 0 | 4909.399 |
| 10 | 4166 | 8.575E+05 | 8.254 | 6.5 | 46 | 0 | 4900.006 |
| 11 | 2083 | 4.288E+05 | 8.51 | 3.3 | 46 | 0 | 4895.681 |
| 12 | 0 | 0 | 0 | 0 | 241 | 0 | 4894.565 |
| 13 | Closed | | | | | | 4894.565 |

As disclosed, the appropriate nozzle orifice size to deliver an equal steam mass flow at each nozzle 22 was calculated by calculating the pressure losses in each of the steam splitter modules 14 based upon the amount of steam injected into the formation F at each steam splitter module 14, which determines the steam condition at each steam splitter module 14.

Knowing the steam condition at each steam splitter module 14 and the formation pressure and mass flow allowed to exit at each of the steam splitter modules 14, the size of the nozzle orifices 24 for each steam splitter module 14 in Example 1 were determined as shown in Table G.

TABLE G

| Injection Pressure [kPa] | 5500 | | |
|---|---|---|---|
| Flow [t/day] | 500 | | Nozzle |
| % Flow to End Nozzle | 0 | Nozzle | Velocity |
| Splitter # | [kPa] | Ø["] | m/s |
| 1 - 4 Nozzles | 5184 | 0.208 | 317 |
| 2 - 4 Nozzles | 5101 | 0.211 | 307 |
| 3 - 4 Nozzles | 5039 | 0.214 | 300 |
| 4 - 4 Nozzles | 4989 | 0.217 | 293 |
| 5 - 4 Nozzles | 4952 | 0.219 | 288 |
| 6 - 4 Nozzles | 4926 | 0.220 | 285 |
| 7 - 4 Nozzles | 4909 | 0.221 | 283 |
| 8 - 4 Nozzles | 4900 | 0.222 | 281 |
| 9 - 4 Nozzles | 4895 | 0.222 | 281 |
| 10 - 4 Nozzles | 4894 | 0.222 | 281 |
| End - 4 Nozzles | 4894 | Closed | |

EXAMPLE 2

Having reference again to FIG. 6, and in a horizontal wellbore such as used for steam injection in a SAGD operation, nozzle orifice sizes were calculated for a steam injection line 10 having ten steam splitter modules S1, S2 . . . S10 resulting in thirteen nodes N1, N2 . . . N13 at which flows were determined.

In this embodiment and having reference to FIGS. 4A-6, the steam splitter module 14*e* at the downhole end 18 of the steam injection line 10 permitted a flow of 30%. Each steam splitter module 14, including the end splitter module 14*e* was designed to have four nozzles 22. Optionally, calculations were also made for a nozzle orifice sized for the end steam splitter module 14*e* wherein the end splitter module 14*e* had only a single end nozzle 22, such as formed in an end 70 of a bullnose cap 72 at the downhole end 18 of the steam injection line 10.

The wellbore conditions and steam injection line parameters were the same as those defined and shown in Table A for Example 1, as were the locations of the steam splitter modules 14 measured from the cross-over X as shown in Table B of Example 1. The upstream steam conditions were also the same as those defined and shown in Table C of Example 1.

The node flows in kg/hr were defined as shown in Table H:

TABLE H

| Node # | Location | Flow kg/hr |
|---|---|---|
| 1 | Surface | 20830 |
| 2 | Crossover (5.5-4.5) | 0 |
| 3 | Splitter 1 | −1458 |
| 4 | Splitter 2 | −1458 |
| 5 | Splitter 3 | −1458 |
| 6 | Splitter 4 | −1458 |
| 7 | Splitter 5 | −1458 |
| 8 | Splitter 6 | −1458 |
| 9 | Splitter 7 | −1458 |
| 10 | Splitter 8 | −1458 |
| 11 | Splitter 9 | −1458 |
| 12 | Splitter 10 | −1458 |
| 13 | End nozzle open | −6250 |

Pressures inside the steam injection line 10 at each node N1 . . . N13 were summarized as shown in Table I:

TABLE I

| Node # | Location | North (m) | East (m) | Up (m) | Pressure kPa a |
|---|---|---|---|---|---|
| 1 | Surface | 0 | 0 | 0 | 5500.0 |
| 2 | Crossover (5.5-4.5) | 0 | 0 | −690 | 5263.3 |
| 3 | Splitter 1 | 37 | 0 | −690 | 5184.783 |
| 4 | Splitter 2 | 84.6 | 0 | −690 | 5095.993 |
| 5 | Splitter 3 | 129 | 0 | −690 | 5023.848 |
| 6 | Splitter 4 | 175 | 0 | −690 | 4959.787 |
| 7 | Splitter 5 | 220 | 0 | −690 | 4906.987 |
| 8 | Splitter 6 | 266 | 0 | −690 | 4862.461 |
| 9 | Splitter 7 | 312 | 0 | −690 | 4826.625 |
| 10 | Splitter 8 | 357 | 0 | −690 | 4799.263 |
| 11 | Splitter 9 | 403 | 0 | −690 | 4778.273 |
| 12 | Splitter 10 | 449 | 0 | −690 | 4763.318 |
| 13 | End Nozzle | 690 | 0 | −690 | 4711.407 |

Should the horizontal portion H of the wellbore deviate from horizontal, pressure differentials resulting from the deviation from horizontal at each steam splitter module 14 are calculated for correcting subsequent calculations. In the example shown, the wellbore was determined to be substantially horizontal.

As in Example 1, the nominal diameter of the tubing string 12 at the vertical section V was 5.5 inches with an inner diameter of about 120 mm when compensated for an indwelling instrument string. The friction factor was 0.0159f and the turbulent friction factor was 0.0157 fT. At the horizontal section H, after the cross-over X, the nominal diameter was 4.5 inches with an internal diameter of about 95.5 mm when compensated for the indwelling instrument string. The friction factor was 0.0167f and the turbulent friction factor was 0.0165 fT.

Additional parameters at each node were calculated and the results are shown in Table J for steam mass flow rates of 1458 kg/hr at each of the steam splitter modules with 30% of the flow (6250 kg/hr) exiting at the end port.

TABLE J

| Node | Pipe Flow (kg/hr) | Reynolds # | Total resistance coefficient (K) | Velocity (m/s) | Pipe Length (m) | Pipe elevation difference (m) | Pressure kPa a |
|---|---|---|---|---|---|---|---|
| 1 | 20830 | 3.361E+06 | 91.515 | 18.2 | 690 | −690 | 5500 |
| 2 | 20830 | 4.248E+06 | 6.455 | 30.2 | 37 | 0 | 5263.3 |
| 3 | 19372 | 3.958E+06 | 8.309 | 28.5 | 47.6 | 0 | 5184.783 |
| 4 | 17914 | 3.669E+06 | 7.755 | 26.8 | 44.4 | 0 | 5095.993 |
| 5 | 16456 | 3.376E+06 | 8.041 | 25.0 | 46 | 0 | 5023.848 |
| 6 | 14998 | 3.082E+06 | 7.873 | 23.1 | 45 | 0 | 4959.787 |
| 7 | 13540 | 2.786E+06 | 8.057 | 21.1 | 46 | 0 | 4906.987 |
| 8 | 12082 | 2.489E+06 | 8.068 | 19.0 | 46 | 0 | 4862.461 |
| 9 | 10624 | 2.191E+06 | 7.906 | 16.8 | 45 | 0 | 4826.625 |
| 10 | 9166 | 1.892E+06 | 8.1 | 14.6 | 46 | 0 | 4799.263 |
| 11 | 7708 | 1.592E+06 | 8.124 | 12.3 | 46 | 0 | 4778.273 |
| 12 | 6250 | 1.291E+06 | 42.753 | 10.0 | 241 | 0 | 4763.318 |
| 13 | | | | | | | 4711.407 |

The size of the nozzle orifices 24 for Example 2 was determined as shown in Table K.

TABLE K

| Injection Pressure [kPa] | 5500 | | |
|---|---|---|---|
| Flow [t/day] | 500 | | Nozzle |
| % Flow to End Nozzle | 0 | Nozzle | Velocity |
| Splitter # | [kPa] | Ø["] | m/s |
| 1 - 4 Nozzles | 5184 | 0.174 | 317 |
| 2 - 4 Nozzles | 5095 | 0.177 | 307 |
| 3 - 4 Nozzles | 5023 | 0.180 | 298 |
| 4 - 4 Nozzles | 4959 | 0.183 | 289 |
| 5 - 4 Nozzles | 4906 | 0.185 | 282 |
| 6 - 4 Nozzles | 4862 | 0.187 | 276 |
| 7 - 4 Nozzles | 4826 | 0.189 | 271 |
| 8 - 4 Nozzles | 4799 | 0.191 | 267 |
| 9 - 4 Nozzles | 4778 | 0.192 | 264 |
| 10 - 4 Nozzles | 4763 | 0.193 | 261 |
| End - 4 Nozzles | 4711 | 0.406 | 253 |
| End - Single Nozzle | | 0.812 | |

The embodiments of the invention in which an exclusive property or privilege is claimed are defined as follows:

1. A steam injection apparatus for delivery of steam to a subterranean formation comprising:

a plurality of steam splitter modules fluidly connected together and adapted for connection to a tubing string for delivery of steam from surface to the plurality of steam splitter modules, each of the plurality of steam splitter modules comprising:

an inner tube having an axis and a bore extending therethrough, the bore adapted for fluid connection to the tubing string for delivery of the steam thereto;

an outer tube positioned concentrically about at least a portion of the inner tube and forming an annular space therebetween, the outer tube having one or more perforations for the delivery of steam from the annular space to the formation; and one or more ports formed in the inner tube for fluidly connecting the bore to the annular space; and sized orifices in the one or more ports for delivering steam from the bore to the annular space, the size of the orifices being selected and changed accordingly to suit changing steam conditions at each of the plurality of steam splitter modules so that a mass rate of the delivery of steam from each of the plurality of steam splitter modules is substantially equal, and the delivery of steam at one or more of the sized orifices is subsonic.

2. The steam injection apparatus of claim 1 further comprising:

interchangeable nozzles having the sized orifices, the interchangeable nozzles being fit to the one or more ports.

3. The steam injection apparatus of claim 1 wherein the one or more ports are angled from perpendicular from the axis of the inner tube for angularly discharging steam into the annular space.

4. The steam injection apparatus of claim 1 wherein one of the plurality of steam splitter modules further comprises:

a steam splitter end module for use at a downhole end of the steam injection apparatus.

5. The steam injection apparatus of claim 4 wherein a down hole end of the end module is closed.

6. The steam injection apparatus of claim 4 wherein the end module is open, further comprising an end port fit with an interchangeable nozzle at a downhole end.

7. The steam injection apparatus of claim 1 further comprising anti-wear means positioned concentrically within the outer tube adjacent areas of impact of the steam from the one or more ports.

8. The steam injection apparatus of claim 7 wherein the anti-wear means are wear rings, the apparatus further comprising:

inner retaining rings for retaining the anti-wear rings in concentric position within the outer tube.

9. The steam injection apparatus of claim 1 wherein each inner tube further comprises an uphole coupling and a downhole coupling, the uphole and downhole couplings having threaded ends for fluidly connecting the plurality of steam splitter modules.

10. The steam injection apparatus of claim 1 wherein the outer tube is retained, positioned concentrically about at least a portion of the inner tube, by end caps.

11. The steam injection apparatus of claim 9 wherein the outer tube is retained, positioned concentrically about at least a portion of the inner tube, by end caps threaded to the uphole and downhole couplings for sandwiching the outer tube therebetween.

12. The steam injection apparatus of claim 1 further comprising at least two annular filter screens positioned across the annular space between the inner and outer tube and spaced uphole and downhole from the one or more ports for sandwiching the one or more ports therebetween.

13. The steam injection apparatus of claim 12 wherein the annular filter screens are sintered metal screens.

14. The steam injection apparatus of claim 12 wherein the annular filter screens are retained in the annular space by inner screen-retaining rings.

15. A method for assembling a steam injection line for delivery of steam to a subterranean formation comprising:

providing a plurality of steam splitter modules in contiguous fluid communication, each of the plurality of steam splitter modules comprising:

an inner tube having a bore extending therethrough for delivery of steam therethrough;

an outer tube positioned concentrically about at least a portion of the inner tube and forming an annular space therebetween for delivery of steam therefrom to the formation; and one or more ports formed in the inner tube for fluidly connecting the bore to the annular space;

calculating a specific orifice size for the one or more ports, the calculated size of the orifices being selected and changed accordingly, to suit steam conditions at each of the plurality of steam splitter modules so as to deliver a mass flow of steam from first sized orifices of a first steam splitter module of the plurality of steam splitter modules that is substantially the same as a mass flow of steam delivered from subsequent sized orifices in each subsequent steam splitter module of the plurality steam splitter modules wherein the delivery of steam at one or more of the sized orifices is subsonic; and fitting the specifically sized orifices in the one or more ports of each of the plurality of steam splitter modules.

16. The method of claim 15 wherein the calculating a specific orifice size further comprises:

defining a number of steam splitter modules required;

defining a mass flow of steam to be delivered from each steam splitter module; and determining the steam conditions at each steam splitter module.

17. The method of claim 15 wherein an elevation of the steam injection apparatus changes along the steam injection line further comprising:

calculating a pressure differential at one or more positions along the steam injection line for correcting the calculating of the specific orifice size for the pressure differential.

18. The method of claim 15 wherein the step of fitting the specifically sized orifices in the one or more ports further comprises:

providing interchangeable nozzles fit to the one or more ports wherein the interchangeable nozzles comprise the specifically sized orifices.

19. The method of claim 18 further comprising:

positioning the interchangeable nozzles in the one or more ports so as to discharge steam angularly therefrom into the annular space.

20. The steam injection apparatus of claim 1 wherein each of the plurality of steam splitter modules deliver steam at subsonic rates.

21. The method of claim 15 wherein the calculating the specific orifice size for the one or more ports according to steam conditions at each of the plurality of steam splitter modules is so as to deliver subsonic mass flow of steam from first sized orifices of the first steam splitter module of the plurality of steam splitter modules that is substantially the same as subsonic mass flow of steam delivered from subsequent sized orifices in each of the subsequent steam splitter modules of the plurality steam splitter modules.

* * * * *

UNITED STATES PATENT AND TRADEMARK OFFICE
Certificate

Patent No. 7,631,694 B2 Patented: December 15, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Arnoud Struyk, Calgary, AB (CA); Denis Gilbert, Calgary, AB (CA); and John Essien Arthur, Calgary, AB (CA).

Signed and Sealed this Twenty-first Day of September 2010.

Shane Bomar
*Supervisory Patent Examiner*
Art Unit 3676
Technology Center 3600